United States Patent [19]

Knuth

[11] 4,121,362

[45] Oct. 24, 1978

[54] KNOCK-DOWN PICTURE FRAME ASSEMBLY

[76] Inventor: Eugene W. Knuth, Land O Lakes, Wis. 54540

[21] Appl. No.: 702,923

[22] Filed: Jul. 6, 1976

[51] Int. Cl.[2] ..... G09F 1/12

[52] U.S. Cl. ..... 40/155

[58] Field of Search ..... 40/152, 155; 403/401, 403/403, 231

[56] References Cited

U.S. PATENT DOCUMENTS

| | | | |
|---|---|---|---|
| 3,064,321 | 11/1962 | Rose | 403/231 |
| 3,552,050 | 1/1971 | Marateck | 40/155 |
| 3,811,214 | 5/1974 | Tate | 40/152 |

FOREIGN PATENT DOCUMENTS

| | | | |
|---|---|---|---|
| 206,921 | 2/1906 | Fed. Rep. of Germany | 403/231 |
| 6,601,842 | 8/1967 | Netherlands | 403/402 |
| 111,295 | 8/1925 | Switzerland | 403/402 |

*Primary Examiner*—Louis G. Mancene
*Assistant Examiner*—Wenceslao J. Contreras
*Attorney, Agent, or Firm*—Edwin E. Greigg

[57] ABSTRACT

What follows is the description of a knock-down picture frame assembly having the usual number of frame members that are provided with mitered surfaces each of which include aligned apertures that extend out through the perimetral walls of the frame members and into which is positioned a locking element.

3 Claims, 4 Drawing Figures

FIG.1
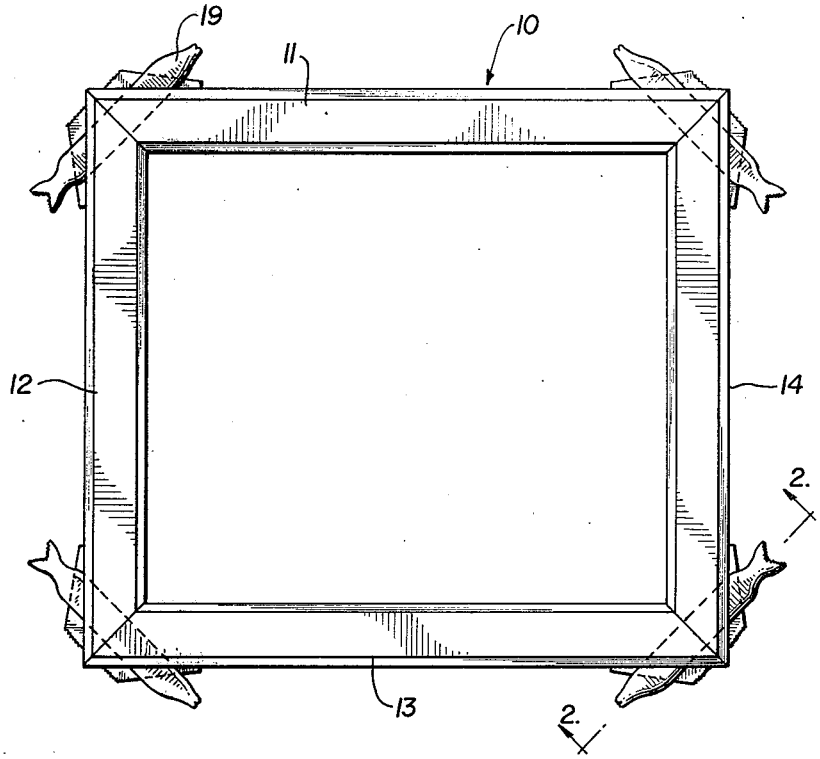
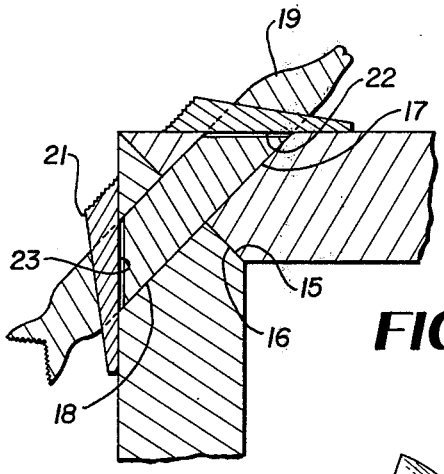
FIG.3
FIG.2
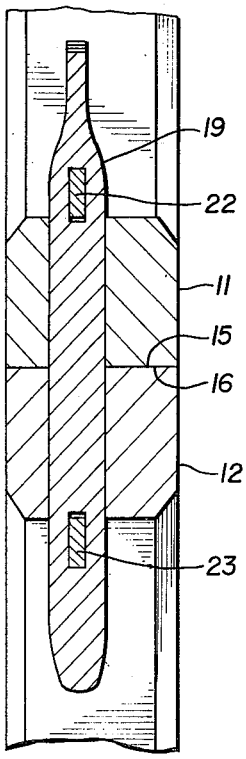
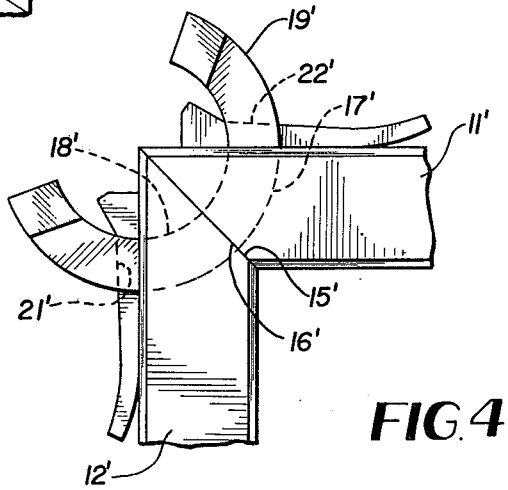
FIG.4

KNOCK-DOWN PICTURE FRAME ASSEMBLY

BACKGROUND OF THE INVENTION

The present invention relates to improvements in knock-down picture frame assemblies and is particularly desirable for use by children or young adults, since the components are in the form of kit and are adaptable to simplified assembly without any tools.

There is now known in the prior art the Marateck U.S. Pat. No. 3,552,050 which also relates to knock-down picture frames, however, the frame elements shown in this patent are held together by coupling members and screws which must be inserted through the perimetral walls of the frame members to engage the coupling members and thereby urge the mitered edges into abutting contact to form a finished picture frame assembly. It is apparent that the patent to Marateck provides the user with no selection of locking means that would add to the overall esthetic value of the ultimate product.

OBJECT AND SUMMARY OF THE INVENTION

Accordingly, the principal object of this invention is to provide a picture frame assembly in kit form which enables the purchaser to put the elements together in an esthetic manner most appealing to the particular individual.

A further object of the invention is to provide a plurality of different types of locking elements which may be changed from time to time, as desired, or as the decor of a room is varied.

Still another object of the invention is to provide a picture frame kit form that can be assembled without any tools.

Other objects and advantages of the present invention will be more readily apparent from a further consideration of the following detailed description of the drawing illustrating a preferred embodiment of the invention, in which:

BRIEF DESCRIPTION OF THE DRAWING

FIG. 1 is an elevational view of one embodiment of this invention showing the locking elements extending through the mitered corners of the frame;

FIG. 2 is a cross-sectional view of line 2—2 of FIG. 1; and

FIG. 3 is a cross-sectional view through a mitered corner.

BRIEF DESCRIPTION OF THE PREFERRED EMBODIMENT

Turning now to the drawing, the view of FIG. 1 depicts, at 10, an assembled picture frame, each component frame member 11, 12, 13 and 14 of which has mitered corner portions that are abutted at assembly as shown at 15 and 16, each said frame member including aligned apertures 17 and 18 and into which may be inserted a non-rotatable connecting element 19 that may have any configuration desired, it only being necessary that the element 19 that is inserted in the aligned apertures 17 and 18 have a perimeter that is complemental thereto.

The rigidifying elements 19 as depicted in the drawing are fish, but this is not considered to be limitative of the type of element that may be used to assemble the components comprising the frame members, but merely representative of one form of aquatic animal that is proposed.

In FIG. 3 there is shown a cross-sectional view through one corner of the picture frame and the element 19 which comprises a fish.

It will be seen that once the elongated body of the fish has been inserted into the mitered corners of the frame members, locking elements 20 and 21 which simulate fins are then introduced into apertures 22 and 23 to thereby lock the rigidifying element 19 against any longitudinal movement relative to the mitered corners 15 and 16.

By way of further illustration of this concept, there is shown in an enlarged detailed view in FIG. 4 another embodiment of this invention wherein the mitered corners 15' and 16' of the frame members 11' and 12' are provided with aligned apertures 17' and 18', each of which are curved as shown in order to permit assembly therewith of an element 19' simulating a horseshoe.

Further, in FIG. 4 the "horseshoe" that holds the corner of the frame member into abutting engagement is apertured as at 21' and 22' to permit entry of locking elements 23' and 24' which take the form of nails.

It is to be understood that the entire picture frame and its component locking elements can be made of wood or any suitable plastic material that will be strong enough to support a picture as well as a sheet of glass where desired.

Without providing illustrations of the various decorative items that could incorporate my invention therein I merely set forth several other embodiments which I have conceived that incorporate my invention but which are not shown in this application.

For example, I have a tennis motif where the tennis racket would comprise the non-rotatable element 19 and the locking elements that cooperate therewith include tennis balls and hearts. In a golfer's motif the non-rotatable element is a golf bag and the wedge-shaped pieces that cooperate therewith simulate golf clubs. There is also a skier's motif in which the non-rotating element is a crutch and the cooperating members associated therewith depict skis. In a gunner's motif a flattened bullet is the non-rotating element and the wedging devices can depict shotguns or rifles. Naturally, with the benefit of the foregoing, decorators, designers and others can adapt my invention to other motifs.

What is claimed is:

1. A knock-down frame assembly comprising frame members each have mitered ends adapted to have the face of a mitered end thereof abut the face of the mitered end of another, said frame members further including perimetral walls, each said frame member having means defining an opening extending through its mitered end, said opening having its longitudinal axis substantially at right angles to the face of the mitered end thereof, the openings of the abutting mitered ends of said sides registering with one another, a connecting element extending entirely through each of the openings in the abutting faces of said frame sides and said perimetral walls and extending outwardly therefrom whereby a cross section of the connecting element and opening depicts at least one flat side between the connector and opening to resist connecting element rotation and wedge elements which traverse through said outwardly extending portions through apertures on said connecting element and abut against said perimetral walls to allow said frame assembly to be connected and disassembled without the need of tools, and wherein said apertures on said connecting elements have a face which is substantially coplanar with the perimetral walls of said frame.

2. A knock-down frame assembly as claimed in claim 1, in which the non-rotatable rigidifying element is arcuate.

3. A knock-down frame assembly as claimed in claim 2, in which said arcuate element simulates a horseshoe.

* * * * *